US012202693B2

(12) United States Patent
Takemoto

(10) Patent No.: US 12,202,693 B2
(45) Date of Patent: Jan. 21, 2025

(54) PAPER SORTING DEVICE AND MACHINING PROCESSING DEVICE

(71) Applicant: DUPLO SEIKO CORPORATION, Kinokawa (JP)

(72) Inventor: Haruka Takemoto, Kinokawa (JP)

(73) Assignee: DUPLO SEIKO CORPORATION, Kinokawa (JP)

( * ) Notice: Subject to any disclaimer, the term of this patent is extended or adjusted under 35 U.S.C. 154(b) by 0 days.

(21) Appl. No.: 18/058,310

(22) Filed: Nov. 23, 2022

(65) Prior Publication Data

US 2023/0303357 A1 Sep. 28, 2023

(30) Foreign Application Priority Data

Mar. 25, 2022 (JP) ..... 2022-050113

(51) Int. Cl.

| | |
|---|---|
| ***B65H 33/12*** | (2006.01) |
| ***B65H 31/20*** | (2006.01) |
| ***B65H 31/30*** | (2006.01) |
| ***B65H 31/34*** | (2006.01) |
| *B65H 35/00* | (2006.01) |

(52) U.S. Cl.

CPC ..... *B65H 31/3054* (2013.01); *B65H 31/20* (2013.01); *B65H 31/34* (2013.01); *B65H 35/0006* (2013.01); *B65H 2404/154* (2013.01); *B65H 2404/25* (2013.01)

(58) Field of Classification Search

CPC ..... B65H 31/20; B65H 31/30; B65H 31/34; B65H 31/3054; B65H 35/0006; B65H 33/12; B65H 2404/154; B65H 2404/25

USPC ..... 271/202

See application file for complete search history.

(56) References Cited

U.S. PATENT DOCUMENTS

| | | | | |
|---|---|---|---|---|
| 5,129,641 | A * | 7/1992 | Long | B65H 5/023 198/572 |
| 6,305,680 | B1 * | 10/2001 | Allen | B65H 83/02 270/52.09 |
| 7,364,398 | B2 * | 4/2008 | Michler | B65H 31/32 414/798.2 |
| 7,470,102 | B2 * | 12/2008 | Gendron | B65H 31/3045 414/796 |
| 10,273,109 | B2 * | 4/2019 | Oguri | B65H 33/16 |

(Continued)

FOREIGN PATENT DOCUMENTS

| | | |
|---|---|---|
| CN | 202 272 548 U | 6/2012 |
| EP | 3 147 245 A1 | 3/2017 |

(Continued)

OTHER PUBLICATIONS

Extended European Search Report dated Aug. 24, 2023, issued by the European Patent Office in corresponding European Application No. 22209376.7-1014, (8 pages).

*Primary Examiner* — Leslie A Nicholson, III

(74) *Attorney, Agent, or Firm* — Buchanan Ingersoll & Rooney, PC

(57) ABSTRACT

A paper sorting device includes: a stacking conveyor that receives continuously fed cut sheets to stack the cut sheets by sorting unit and that continuously conveys stacked cut sheets downstream on a unit-by-unit basis; and a stacker section arranged downstream of the stacking conveyor, capable of continuously stacking the stacked cut sheets conveyed from the stacking conveyor, at different positions on a placement surface.

18 Claims, 9 Drawing Sheets

(56) References Cited

U.S. PATENT DOCUMENTS

| | | | | |
|---|---|---|---|---|
| 10,287,113 | B2 * | 5/2019 | Adami | B65G 57/035 |
| 2018/0086586 | A1 | 3/2018 | Oguri et al. | |

FOREIGN PATENT DOCUMENTS

| | | | |
|---|---|---|---|
| EP | 3 299 321 | A1 | 3/2018 |
| JP | 2018052741 | A | 4/2018 |

* cited by examiner

PAPER SORTING DEVICE AND MACHINING PROCESSING DEVICE

BACKGROUND

1. Technical Field

The present disclosure relates to a paper sorting device attached to the ejection side of a paper machining processing device, etc. to stack and sort, every specified number, sheets ejected in the form of cut sheets, and to a machining processing device including the paper sorting device.

2. Related Art

A conveyor stacker has been known as a stacker device that stacks sheets ejected in the form of cut sheets from a machining processing device. The conveyor stacker is a device including: a belt conveyor that slowly conveys cut sheets after cutting machining ejected from the machining processing device; and a stacker disposed at an end of belt conveyor to allow adjacent cut sheets to be gradually shifted and partially stacked while diagonally leaning thereon.

JP 201852741 A discloses a paper sorting device that stacks sheets ejected in the form of the cut sheets on the belt conveyor, every specified number.

The conveyor stacker is time-consuming in that the operator is required to align, every specified number, cut sheets partially stacked while being leaned on the stacker.

In the paper sorting device disclosed in JP 201852741 A, sheets ejected in the form of cut sheets are conveyed to a downstream side with a predetermined gap while being stacked every specified number on a single (one-drive) belt conveyor. Hence, stacking work (ejection work) of the succeeding ejected sheets needs to be suspended during conveying preceding sheets (during running of the belt conveyor) until the predetermined gap is secured on the downstream side, resulting in poor work efficiency. The predetermined gap is a gap necessary for easy removal when the operator removes the stacked cut sheets on the belt conveyor.

SUMMARY

An object of the present disclosure is to provide a paper sorting device and a machining processing device, capable of improving the work efficiency in sorting work that receives a plurality of continuously fed cut sheets to stack them by sorting unit into stacked cut sheets.

A paper sorting device according to an aspect of the present disclosure includes a stacking conveyor, a stacker section arranged downstream of the stacking conveyor, and a controller. The stacking conveyor includes a first placement section receiving continuously fed cut sheets to stack the cut sheets by sorting unit, wherein stacked cut sheets are placed, and a first drive section continuously conveying the stacked cut sheets placed on the first placement section downstream on a unit-by-unit basis along the first placement section. The stacker section includes a second placement section wherein the stacked cut sheets conveyed from the stacking conveyor are placed, and a second drive section continuously conveying the stacked cut sheets placed on the second placement section downstream along the second placement section. The controller controls the first drive section and the second drive section such that precedingly conveyed stacked cut sheets and succeeding stacked cut sheets among plural units of stacked cut sheets conveyed to the stacker section by the stacking conveyor are placed, with a predetermined gap formed therebetween, at different positions on the second placement section.

A machining processing device according to another aspect of the present disclosure includes a machining processing section including a machining member that performs predetermined machining processing at a predetermined position on a sheet conveyed, and a paper sorting device receiving cut sheets after machining processing continuously ejected from the machining processing section. The paper sorting device includes a stacking conveyor, a stacker section arranged downstream of the stacking conveyor, and a controller. The stacking conveyor includes a first placement section receiving continuously fed cut sheets to stack the cut sheets by sorting unit, wherein stacked cut sheets are placed, and a first drive section continuously conveying the stacked cut sheets placed on the first placement section downstream on a unit-by-unit basis along the first placement section. The stacker section includes a second placement section wherein the stacked cut sheets conveyed from the stacking conveyor are placed, and a second drive section continuously conveying the stacked cut sheets placed on the second placement section downstream along the second placement section. The controller controls the first drive section and the second drive section such that precedingly conveyed stacked cut sheets and succeeding stacked cut sheets among plural units of stacked cut sheets conveyed to the stacker section by the stacking conveyor are placed, with a predetermined gap formed therebetween, at different positions on the second placement section.

According to the present disclosure there can be provided the paper sorting device and the machining processing device, capable of improving the work efficiency in sorting work that receives a plurality of continuously fed cut sheets to stack them by sorting unit into stacked cut sheets.

BRIEF DESCRIPTION OF THE DRAWINGS

FIGS. 91, 9J and 9K are diagrammatic views showing how the paper sorting device performs sorting action.

EMBODIMENT(S) FOR CARRYING OUT THE INVENTION

Figure 1:
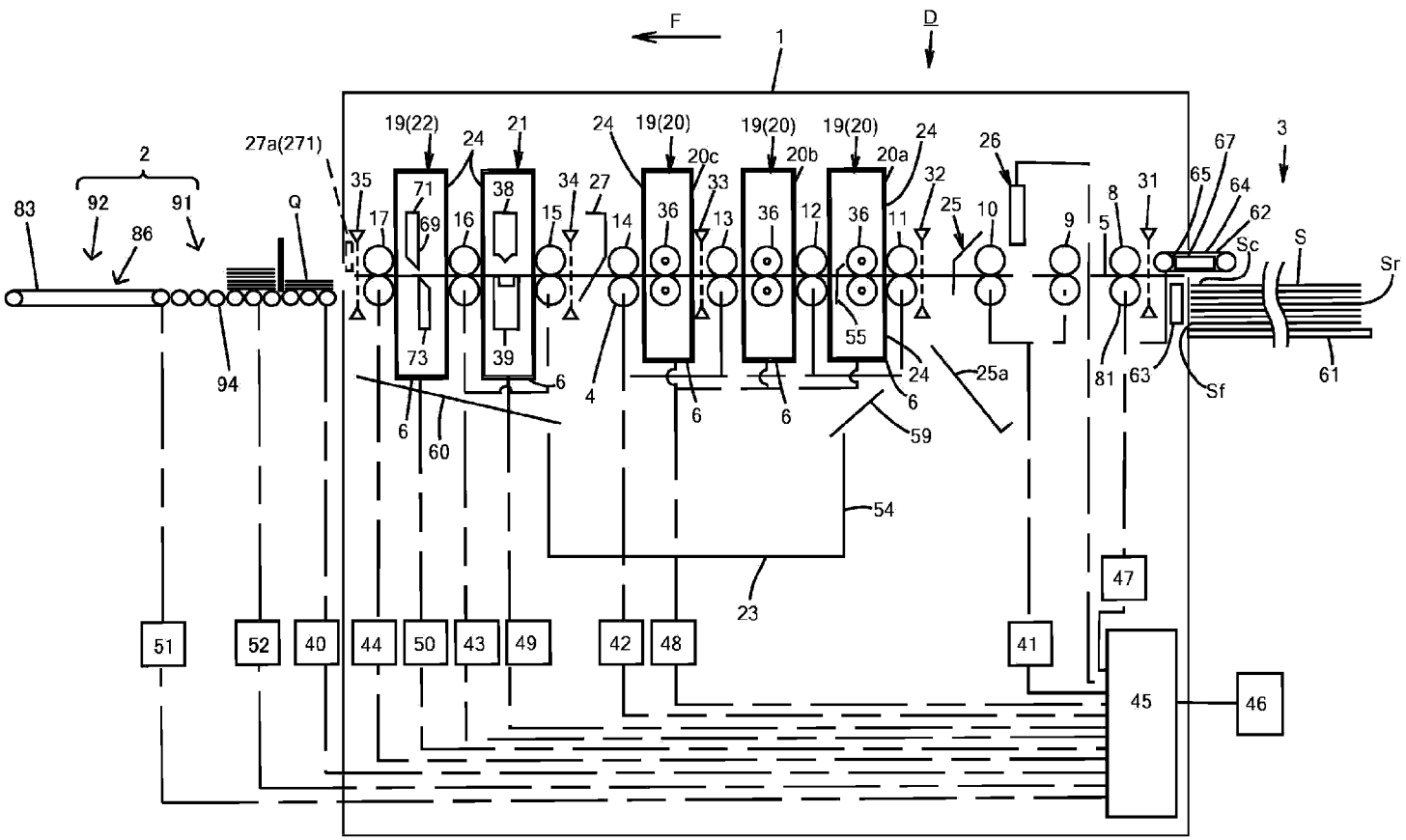
FIG. 1 is a longitudinal sectional view showing a schematic configuration of a machining processing device according to an embodiment of the present disclosure.

A paper sorting device according to a first aspect of the present disclosure includes: a stacking conveyor including a first placement section receiving continuously fed cut sheets to stack the cut sheets by sorting unit, wherein stacked cut sheets are placed, and a first drive section continuously conveying the stacked cut sheets placed on the first placement section downstream on a unit-by-unit basis along the first placement section; a stacker section including a second placement section arranged downstream of the stacking conveyor, wherein the stacked cut sheets conveyed from the stacking conveyor are placed, and a second drive section continuously conveying the stacked cut sheets placed on the second placement section downstream along the second placement section; and a controller controlling the first drive section and the second drive section such that precedingly conveyed stacked cut sheets and succeeding stacked cut sheets among plural units of the stacked cut sheets conveyed to the stacker section by the stacking conveyor are placed, with a predetermined gap formed therebetween, at different positions on the second placement section. This can improve the work efficiency in sorting.

A paper sorting device according to a second aspect of the present disclosure is the paper sorting device of the first aspect, wherein the first placement section of the stacking conveyor allows plural units of the stacked cut sheets to be placed thereon in a conveyance direction, and wherein the controller provides control in the first placement section of the stacking conveyor at least such that, upon stacking the cut sheets, the cut sheets are received and stacked by sorting unit with transfer stopped, after which the stacked cut sheets are accumulated as plural units of the stacked cut sheets while being sequentially stepwise shifted, the stacked cut sheets being sequentially stepwise delivered to the second placement section of the stacker section from the accumulated units of the stacked cut sheets. This can improve the work efficiency in sorting.

A paper sorting device according to a third aspect of the present disclosure is the paper sorting device of the first or the second aspect, wherein the first drive section of the stacking conveyor and the second drive section of the stacker section are driven independently of each other to convey the stacked cut sheets. This can improve the work efficiency in sorting.

A paper sorting device according to a fourth aspect of the present disclosure is the paper sorting device of any one of the first to the third aspects, wherein the controller controls the first drive section and the second drive section such that the predetermined gap between adjacent units of the stacked cut sheets placed on the second placement section of the stacker section is greater than a gap between adjacent units of the stacked cut sheets placed on the first placement section of the stacking conveyor. This can improve the work efficiency in sorting.

A paper sorting device according to a fifth aspect of the present disclosure is the paper sorting device of any one of the first to the fourth aspects, wherein in the stacker section, the second placement section is a belt conveyor having a running-around belt wherein the stacked cut sheets are stacked, and the second drive section is a motor driving the running-around belt. This enables means for stacking and conveying the stacked cut sheets to be simply configured at a low cost.

A paper sorting device according to a sixth aspect of the present disclosure is the paper sorting device of any one of the first to the fifth aspects, wherein in the stacking conveyor, the first placement section is conveyance rollers that are a plurality of rotating rollers wherein the stacked cut sheets are stacked, and the first drive section is a motor driving the conveyance rollers. This enables the means for stacking and conveying the stacked cut sheets to be simply configured at a low cost.

A paper sorting device according to a seventh aspect of the present disclosure is the paper sorting device of the sixth aspect, wherein the stacking conveyor includes side guides that, during stacking continuously ejected cut sheets, restrict the cut sheets in a paper conveyance width direction, the side guides each having a side wall with notches each receiving a corresponding one of the plurality of rollers so that their respective setting positions in the paper conveyance width direction are adjustable through the notches. According to this, there are no problems such as paper slipping through gaps between the side wall and the plurality of rollers, achieving improvement in alignment performance in the paper conveyance width direction of cut sheets stacked on the paper sorting device.

A paper sorting device according to an eighth aspect of the present disclosure is the paper sorting device of the sixth or the seventh aspect, wherein the stacking conveyor includes, between adjacent ones of the plurality of roller, an auxiliary guide for filling a corresponding one of gaps on a paper conveyance path. This can prevent occurrence of jam on the paper conveyance path.

A paper sorting device according to a ninth aspect of the present disclosure is the paper sorting device of any one of the first to the fifth aspects, wherein in the stacking conveyor, the first placement section is a belt conveyor having a running-around belt wherein the stacked cut sheets are stacked, and the first drive section is a motor driving the running-around belt. This enables the means for stacking and conveying the stacked cut sheets to be simply configured at a low cost.

A paper sorting device according to a tenth aspect of the present disclosure is the paper sorting device of any one of the first to the ninth aspects, wherein in order to receive and stack cut sheets continuously ejected by sorting unit, the stacking conveyor includes an abutment guide that advances relative to a conveyance path at least during stacking, to restrict leading edges of the cut sheets. This can improve the alignment performance in the paper conveyance direction of cut sheets stacked on the paper sorting device.

A machining processing device according to an eleventh aspect includes: a machining processing section including a machining member that performs predetermined machining processing at a predetermined position on a sheet conveyed; and a paper sorting device of any one of the first to the tenth aspects that receives cut sheets after machining processing continuously ejected from the machining processing section. This can improve the work efficiency in sorting.

EMBODIMENT

Referring to the drawings, description will now be given of a paper sorting device according to one embodiment of the present disclosure and a machining processing device including the paper sorting device.

Overall Configuration of Machining Processing Device D

A schematic overall configuration of the machining processing device according to the embodiment of the present disclosure will be described with reference to the drawings. In the following description, let width direction W be a direction orthogonal to a conveyance direction F of a conveying section 4 that conveys a sheet S, and let right side and left side of the device be the right side and the left side, respectively, when the downstream side is viewed from the upstream side in the conveyance direction F. FIG. 1 is a schematic longitudinal sectional view of a machining processing device D according to the present disclosure. In FIG. 1, the machining processing device D includes: a feeding section 3 disposed at an upstream end of a device body 1 in the conveyance direction F of the sheet S (cut sheets); a paper sorting device 2 for placing cut sheets Q after machining processing, disposed at a downstream end in the conveyance direction F; and a substantially horizontal conveyance path 5 extending between the feeding section 3 and the paper sorting device 2.

The conveyance path 5 includes the conveying section 4 having plural pairs of upper and lower conveyance rollers 9 to 17. The conveyance rollers 9 to 17 are arranged at intervals in the conveyance direction F. The conveyance rollers 9 to 17 making up the conveying section 4 are coupled via a power transmission mechanism not shown to conveyance drive sections 41 to 44, respectively. The conveyance drive sections 41 to 44 are electrically connected to a controller 45.

The controller 45 is a controller that provides control over the entire machining processing device D. The controller 45 includes a general-purpose processor such as a CPU or an MPU that executes a program to achieve a predetermined function. The controller 45 includes a storage and calls/runs a control program stored in the storage to thereby implement various controls over the machining processing device D. The controller 45 is not limited to one achieving a predetermined function through cooperation between hardware and software. It may be a hardware circuit dedicatedly designed to achieve a predetermined function. In this manner, the controller 45 may be implemented by various processors, such as CPU, MPU, GPU, FPGA, DSP, ASIC, etc.

The storage included in the controller 45 is a record medium that records various pieces of information. The storage is implemented, for example, by a flash memory, a solid state device (SSD), a hard disk, or other storages or by appropriately combining them. The storage stores a control program or the like executed by the processor.

An operation panel 46 and a reading section 26 are electrically connected to an interface of the controller 45. The operation panel 46 is configured to act as both a display section and a setting section for setting various types of processing information containing information on a cutting process of the sheet S. The reading section 26 is configured as the setting section.

The conveyance path 5 is disposed with machining processing sections 24 that machine and process the sheet S conveyed. In FIG. 1, the machining processing sections 24 include cutting sections 19 and a crease processing section 21 that forms a fold orthogonal to the conveyance direction F. The cutting sections 19 are composed of three slitter processing sections 20 and a cutter processing section 22.

The slitter processing sections 20, the crease processing section 21, and the cutter processing section 22 are each configured as a removable unit so as to be attached and detached at a desired position within the device body 1 by a cassette system. It is therefore possible, depending on the type of processing, to change the order of arrangement of the processing sections 20, 21, and 22 or to replace them with other machining processing sections 24 along the conveyance direction F, such as a creasing mechanism, a chamfering mechanism, and a perforating mechanism or add the other machining processing sections 24 thereto.

The reading section 26 and a reject mechanism 25 are arranged upstream of the slitter processing section 20, while a cutting waste removal mechanism 27 is arranged downstream of the slitter processing section 20. A cutting waste collecting section 23 is arranged at a lower part within the device body 1.

On the conveyance path 5 there are further arranged a plurality of light transmissive detecting sections 31 to 35 that detect a front edge (downstream edge) Sf or a rear edge (upstream edge) Sr of the sheet S and that are each electrically connected to the interface of the controller 45. The first detecting section 31 on the most-upstream side in the conveyance direction F of the sheet S is arranged between a suction conveying section 62 and feed rollers 8 of the feeding section 3. The next second detecting section 32 is arranged in the upstream vicinity of the slitter processing sections 20. The next third detecting section 33 is arranged halfway through the slitter processing sections 20. The next fourth detecting section 34 is arranged in the upstream vicinity of the crease processing section 21. The fifth detecting section 35 on the most-downstream side is arranged in the upstream vicinity of a stacker section 2.

The first detecting section 31 detects the front edge Sf of the sheet S, in the stage before being gripped by the feed rollers 8, suction-conveyed by the suction conveying section 62 of the feeding section 3 or detects the rear edge Sr of the sheet S gripped and conveyed by the feed rollers 8. The first detecting section 31 is used to calculate the position of the sheet S being thereafter conveyed on the conveyance path 5, based on the detected position of the sheet S.

The second detecting section 32 and the third detecting section 33 detect jamming of the sheet S during processing. The fourth detecting section 34 is auxiliarily disposed to correct sheet position information obtained at the first detecting section 31 to make the sheet position information more accurate in case there accumulates misalignment (conveyance error) of the sheet S in the conveyance direction F during processing on the conveyance path 5 as a result of the elongated conveyance path 5. The fifth detecting section 35 detects ejection of the cut sheets Q after machining processing to the paper sorting device 2. The fifth detecting section 35 detects jamming, etc. of the cut sheets Q in the paper sorting device 2.

Feeding Section 3

The feeding section 3 includes a feed table 61, the feed rollers 8, the suction conveying section 62, and a separation air blowing section 63. The feed table 61 is disposed to stack sheets S thereon and feed the sheets S to the conveyance path 5. The feed table 61 can be raised and lowered by lifting means not shown. When feeding the sheet S, a topmost sheet S is suction-conveyed by the suction conveying section 62. To that end, the lifting means raises the feed table 61 from a standby position up to a feed position at a predetermined height where the topmost sheet S can be fed onto the conveyance path 5. The feed table 61 is thus movable between the standby position and the feed position.

The feed rollers 8 are disposed as upper and lower rollers in pairs. The suction conveying section 62 includes a suction fan 67, a conveyance belt 64, and belt rollers 65. The feeding section 3 feeds a predetermined number of sheets S stacked on the feed table 61 to the conveyance path 5, one by one in order from the top, by using the suction conveying section 62 and the pair of upper and lower feed rollers 8.

The separation air blowing section 63 blows air by a fan not shown toward the front edge Sf of the sheet S on the feed table 61, to separate a topmost sheet S from a plurality of sheets S stacked, allowing the suction conveying section 62 to suck and convey the separated topmost sheet S. The belt roller 65 on one hand and a lower feed roller 81 of the feed rollers 8 are connected to a paper-feed drive section 47. The separation air blowing section 63, the suction fan 67, and the paper-feed drive section 47 are electrically connected to the controller 45.

Reading Section 26

Figure 2:
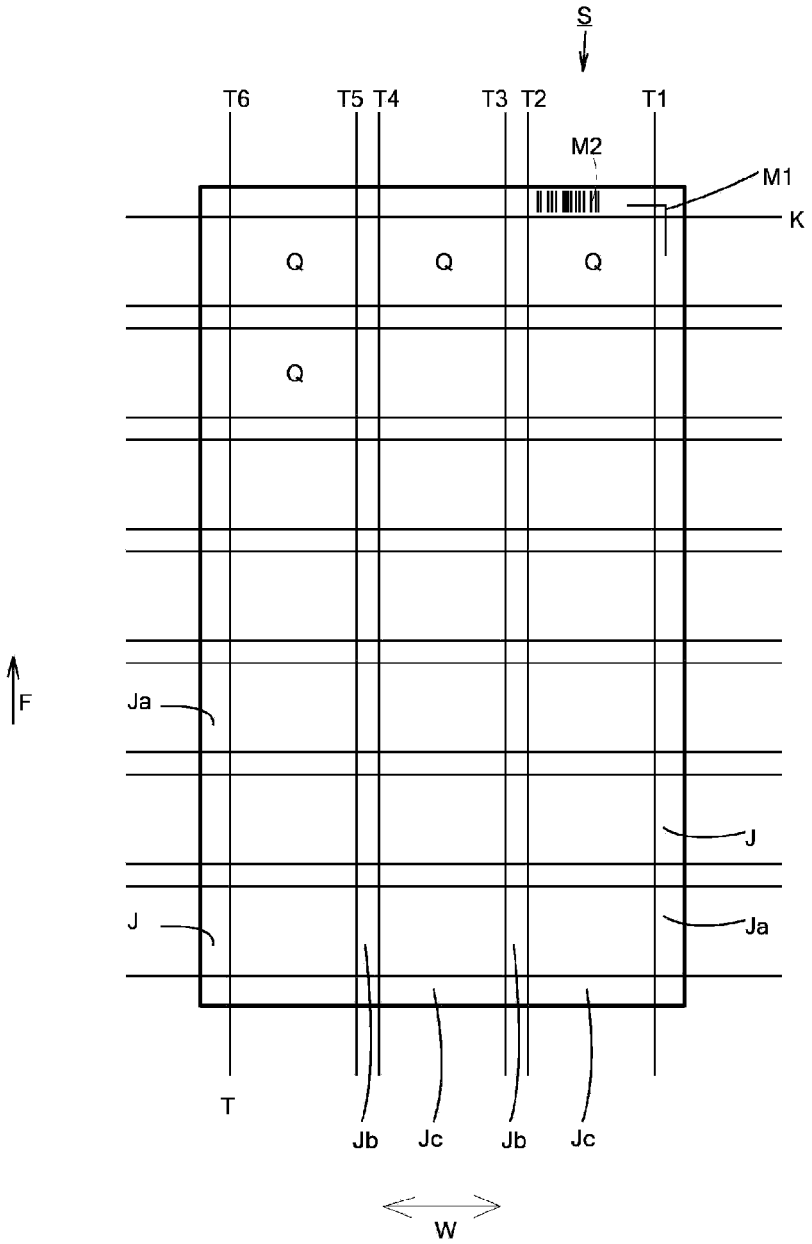
FIG. 2 is a plan view showing an example of a machining process pattern of a sheet.

The reading section 26 reads an image of a position mark M1 printed on a front corner of a sheet S as shown in FIG. 2, to detect a machining reference position in the conveyance direction F of the sheet S and the width direction W orthogonal to the conveyance direction F. Aside from manual entry of various types of machining process information through the operation panel 46, the reading section 26 can be configured as a setting section that automatically reads and sets machining process information. Specifically, the reading section 26 reads an image of a bar code M2 printed on a front end of the sheet S as shown in FIG. 2, to acquire information on various types of machining processes to be applied to the sheet S. The reading section 26 is composed of a CCD sensor, etc.

Reject Mechanism 25

In case the reading section 26 cannot read the position mark M1 or the bar code M2 printed on a sheet S due to blur, the reject mechanism 25 of FIG. 1 acts on the unreadable sheet S to allow it to drop and collected by the tray 25*a*.

Slitter Processing Section 20

The slitter processing sections 20 includes three units arrayed in the conveyance direction F, each unit having two pairs of cutting blades 36 spaced apart in the width direction W, each pair composed of upper and lower rotary cutting blades. The cutting blades 36 are disposed movably in an intersectional direction intersecting the conveyance direction F of the conveying section 4, and act as a machining member that applies predetermined machining processing at a predetermined position on the sheet S conveyed. The cutting blades 36 on either one of the upper side or the lower side of the conveyance path 5 are rotated by a driving force of a rotation drive section 48 as a machining member drive section that drives the machining member, with the cutting blades 36 on the other side being drivenly rotated, to thereby cut the sheet S along the conveyance direction F of the conveying section 4 so that cutting lines T are formed on the sheet S.

Crease Processing Section 21

The crease processing section 21 includes: a lower die 39 having an upper concave portion; and an upper die 38 having a lower convex portion that fits into the concave portion, the upper die 38 being coupled via a power transmission mechanism to a folding drive section 49 such as a motor. The upper die 38 is lowered by a driving force of the folding drive section 49, whereby folds are formed on the sheet S in the width direction W orthogonal to the conveyance direction F.

Cutter Processing Section 22

The cutter processing section 22 includes a pair of cutting blades 69 facing each other that extend in the width direction W. The cutting blade 69 on one hand is configured as an upper movable blade 71, while the cutting blade 69 on the other is in the form of a lower fixed blade 73. The upper movable blade 71 comes into contact with and separates from the lower fixed blade 73, to cut the sheet S in the width direction W orthogonal to the conveyance direction F so that cutting lines K are formed on the sheet S. The upper movable blade 71 is coupled via a power transmission mechanism to a cutting drive section 50 such as a motor.

Paper Sorting Device 2

The paper sorting device 2 is composed of a stacking conveyor 91 and a stacker section 92. The stacking conveyor 91 receives cut sheets Q after machining processing continuously ejected from the device body 1 (machining processing section) and stacks the cut sheets Q by sorting unit to thereafter continuously convey the cut sheets Q for each stacked cut sheets Q' to be stacked. The cut sheets Q stacked by sorting unit will hereinafter be referred to as stacked cut sheets Q'. The stacker section 92 is arranged downstream of the stacking conveyor 91, and sorts and continuously stacks the stacked cut sheets Q' conveyed from the stacking conveyor 91, at different positions on a placement surface.

The stacking conveyor 91 includes: a first placement section on which the stacked cut sheets Q' are placed; and a first drive section that conveys the stacked cut sheets Q' placed on the first placement section, downstream along the first placement section. In the stacking conveyor 91, the first placement section includes e.g. conveyance rollers that are a plurality of rotating rollers 94 (driving rollers) on which the stacked cut sheets Q' are stacked, and the first drive section is a roller drive section 40 that drives the conveyance rollers. The stacker section 92 includes a placement section 83 as a second placement section that is capable of sorting and stacking the stacked cut sheets Q' at different positions on the placement surface. The placement section 83 includes a belt conveyor 86 having a running-around belt 85 on which the stacked cut sheets Q' are stacked. The stacked cut sheets Q' conveyed from the stacking conveyor 91 are placed on the belt conveyor 86 while being conveyed. A second drive section is a conveyor drive section 51 driving the belt that runs around. The stacking conveyor 91 may include a belt conveyor 88 instead of the plurality of rotating rollers 94.

The stacking conveyor 91 and the stacker section 92 are driven independently of each other to convey the stacked cut sheets Q'. The roller drive section 40 is electrically connected to the controller 45, which controls the amount of drive of the roller drive section 40 so that the plurality of rollers 94 are adjusted to run at a predetermined velocity. The conveyor drive section 51 is electrically connected to the controller 45, which controls the amount of drive of the conveyor drive section 51 so that the belt conveyor 86 is adjusted to run at a predetermined velocity.

A specific configuration and action of the paper sorting device 2 will be described later.

Cutting Waste Collecting Section 23

The cutting waste collecting section 23 includes a cutting waste storage box 54 and guides 59 and 60. The cutting waste storage box 54 is formed in a rectangular parallelepiped shape with an upper opening. The cutting waste storage box 54 collects and stores cutting wastes J that are no longer needed, cut off in the cutting section 19. The guides 59 and 60 guide falling cutting waste cut off in the cutting section 19, to the cutting waste storage box 54.

Controller 45

The controller 45 controls action of the entire machining processing device D. The controller 45 acquires information from the detecting sections 31 to 35 and controls the driving of the feeding section 3, the conveying section 4, the paper sorting device 2, and the machining processing sections 24 based on machining process information of the sheet S set by the operation panel 46 or the reading section 26, to perform machining processing of the sheet S. Although in this embodiment the case will be described where a controller controlling action of the paper sorting device 2 is included in the controller 45 of the machining processing device D, the controller controlling action of the paper sorting device 2 may be disposed separately from the controller 45 of the machining processing device D. For example, the paper sorting device 2 itself may include a controller so that the controller controls action of the paper sorting device 2.

Sheet Machining Process Pattern

FIG. 2 is a plan view showing an example of a machining process pattern of the sheet S. According to the machining process pattern shown in FIG. 2, a plurality of cut sheets Q are produced from one sheet S. The pattern has a plurality of cutting lines T as machining lines extending parallel to the conveyance direction F and a plurality of cutting lines K as machining lines extending in the width direction W orthogonal to the conveyance direction F.

Figure 5:
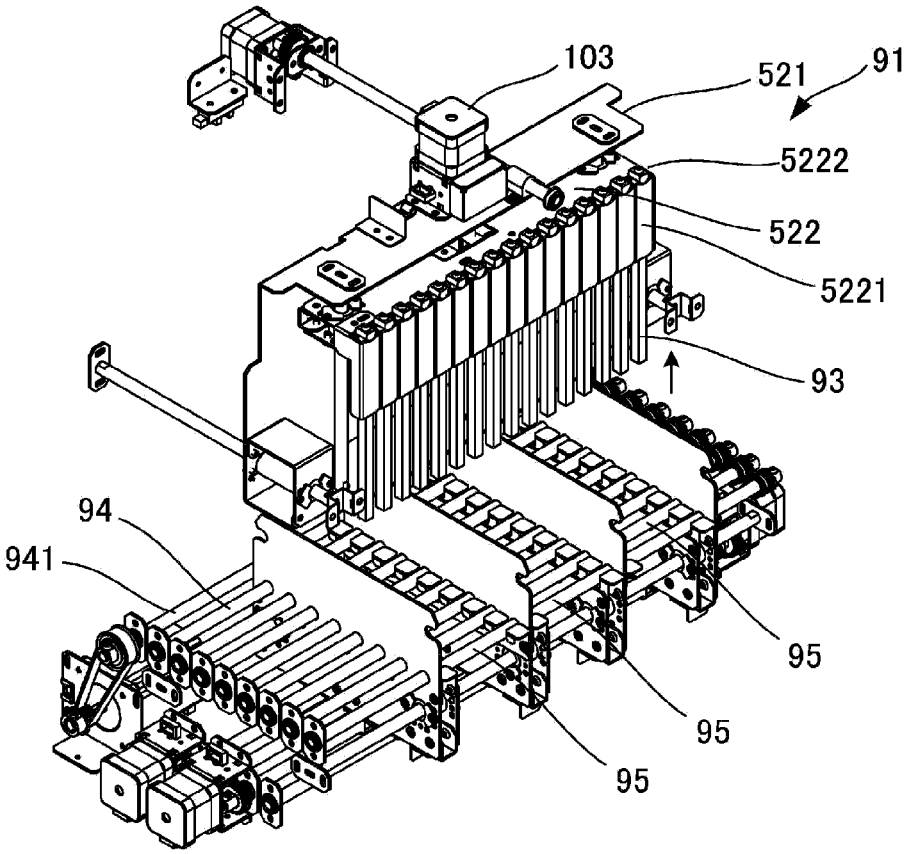
FIG. 5 is a perspective view of the stacking conveyor.

First and sixth cutting lines T1 and T6 indicated at right and left ends, respectively, in FIG. 2 are formed on the conveyance path 5 of FIG. 5 by a most upstream unit 20*a* of the slitter processing sections 20. Second and fifth cutting lines T2 and T5 formed inside of the first and sixth cutting lines T1 and T6, respectively, are formed by a central unit 20*b* in the conveyance direction F. Third and fourth cutting lines T3 and T4 formed inside of the second and fifth cutting lines T2 and T5 are formed by a most downstream unit 20*c* in the conveyance direction F. Unnecessary band-like cutting wastes Jb between the second cutting line T2 and the third cutting line T3 and between the fourth cutting line T4 and the fifth cutting line T5 is guided downward by the cutting waste removal mechanism 27 shown in FIG. 1 and is collected by the cutting waste collecting section 23.

Cutting lines K are formed by performing simultaneous cutting processing plural times on a plurality of band-like cutting pieces juxtaposed in the width direction W, the cutting pieces being obtained by cutting the sheet S along the cutting lines T1 to T6 in parallel to the conveyance direction F and then removing elongated cuffing wastes J cut off from the sheet S.

Since the machining process pattern of the sheet S shown in FIG. 2 has no fold lines formed by the crease processing section 21, the machining processing section 24 exemplified in FIG. 1 houses the crease processing section 21 within a receiving section 6 to prohibit it from functioning to execute creasing processing; replaces the crease processing section 21 with a conveyance processing section not shown; or detaches the crease processing section 21 from the receiving section 6 to use it in empty state.

Information on various types of machining processes to be applied to the sheet S based on such an arrangement pattern of cut sheets Q after machining processing is set using the operation panel 46 by the user or is recorded in the bar code M2 on the sheet S. These various types of machining process information includes information on machining processing of the sheet S, such as: information on the sheet S itself, such as the length of the sheet S in predetermined directions such as the length in the conveyance direction and the length in the width direction, the sheet thickness, and the sheet type; information on the cut sheets Q, such as the array, the number, and dimensions of the cut sheets Q; information on the sizes and the number of unnecessary cutting wastes J cut off from the sheet S; and information on sorting processing of the cut sheets Q. The information on sorting processing includes: sorting necessary/unnecessary information on whether to execute sorting processing by the paper sorting device 2; sorting timing information on timing to execute sorting processing; sorting distance information on the distance between cut sheets Q sorted into front and rear on the placement section 83; sort stacking information on how to stack sorted cut sheets Q, such as the overlapping length between preceding cut sheets Q and succeeding cut sheets Q; and sorting notification information on whether to notify with light or sound when sorting.

Machining process information that has been set once can be stored in a storage of the controller 45. A number, a title or name of processing, or the like is issued for each of different pieces of machining process information, such as the array pattern of cut sheets Q after machining processing the sheet S, and stored in the storage so that the user can operate the operation panel 46 as the operating section to call machining process information on required processing contents from the storage, for processing the sheet S.

Configuration of Paper Sorting Device 2

A specific configuration of the paper sorting device 2 will then be described with reference to FIGS. 3 to 6.

Figure 3:
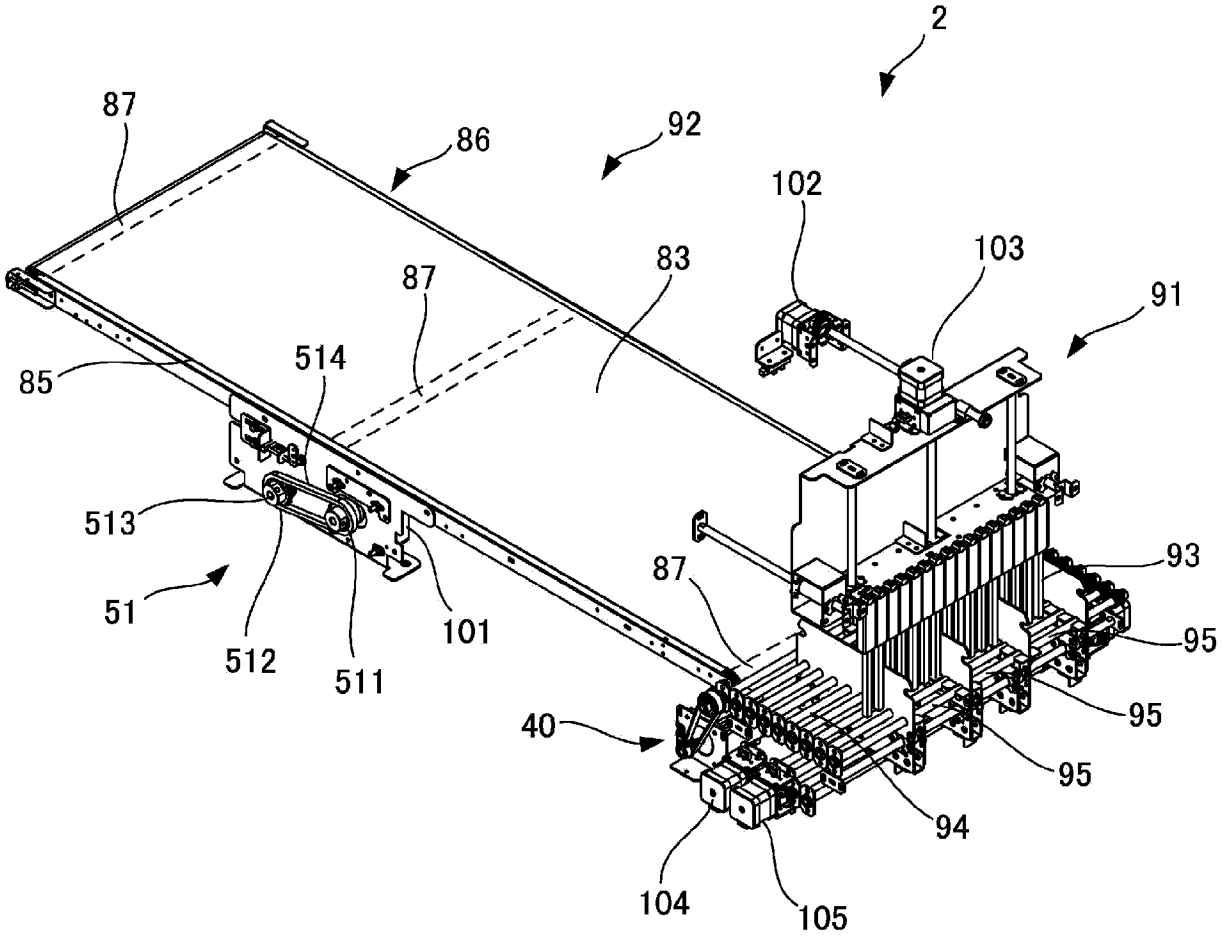
FIG. 3 is an overall perspective view of a paper sorting device.

As shown in FIG. 3, the paper sorting device 2 is composed of the stacking conveyor 91 and the stacker section 92, which are driven independently of each other. In the stacking conveyor 91, the cut sheets Q after machining processing continuously ejected from the device body 1 (machining processing section) are received on a placement section 95 and stacked by sorting unit, after which they are continuously conveyed downstream for each unit of the stacked cut sheets Q'. The stacker section 92 is arranged downstream of the stacking conveyor 91 and sorts and continuously stacks the stacked cut sheets Q' conveyed from the stacking conveyor 91, at different positions on the placement surface. For detail, the stacking conveyor 91 includes the conveyance rollers that are the plurality of rotating rollers 94 (driving rollers) on which the stacked cut sheets Q' are stacked. The stacker section 92 includes the placement section 83 on which the stacked cut sheets Q' can be sorted and stacked at different positions on the placement surface. The placement section 83 includes the belt conveyor 86 having the running-around belt 85 on which the stacked cut sheets Q' are stacked. The stacked cut sheets Q' conveyed from the stacking conveyor 91 are placed on the belt conveyor 86 while being conveyed. The stacking conveyor 91 may include a belt conveyor 88 in place of the plurality of rotating rollers 94.

By using the belt conveyors 86 and 88 in the stacker section 92 and the stacking conveyor 91, respectively, the means for stacking and conveying the stacked cut sheets Q' can be simply configured at a low cost.

The belt conveyor 86 in the stacker section 92 includes the endless belt 85, conveyor rollers 87, and the conveyor drive section 51. The conveyor rollers 87 are disposed at three points spaced a predetermined distance apart from each other in the ejection direction of the stacked cut sheets Q', which is the same direction as the conveyance direction F of the sheet S, with the belt 85 being passed over the conveyor rollers 87. The conveyor drive section 51 is a drive mechanism for rotating the endless belt 85 to convey the sorting processed stacked cut sheets Q' downstream in the paper conveyance direction F. The conveyor drive section 51 includes: a drive motor 101 functioning as drive means; a pulley 511 attached to a rotating shaft of the drive motor 101; a pulley 512 attached to a rotating shaft 513 of the conveyor roller 87; and a timing belt 514 passing over the pulleys 511 and 512. When the drive motor 101 is rotationally driven, its driving force is transmitted via the pulleys 511 and 512 to the rotating shaft 513 of the conveyor roller 87, with the result that the conveyor roller 87 rotates to cause the endless belt 85 to rotate.

The belt 85 has a length in the width direction W that is a predetermined length substantially equal to or slightly longer than the length in the width direction W of the conveyance path 5 on which the sheet S is conveyed, thereby allowing a plurality of machined cut sheets Q ejected in parallel in the width direction W to be placed on the belt 85. The conveyor drive section 51 is electrically connected to the controller 45, which controls the amount of drive of the conveyor drive section 51 so that the belt conveyor 86 is adjusted to run at a predetermined velocity.

Figure 4:
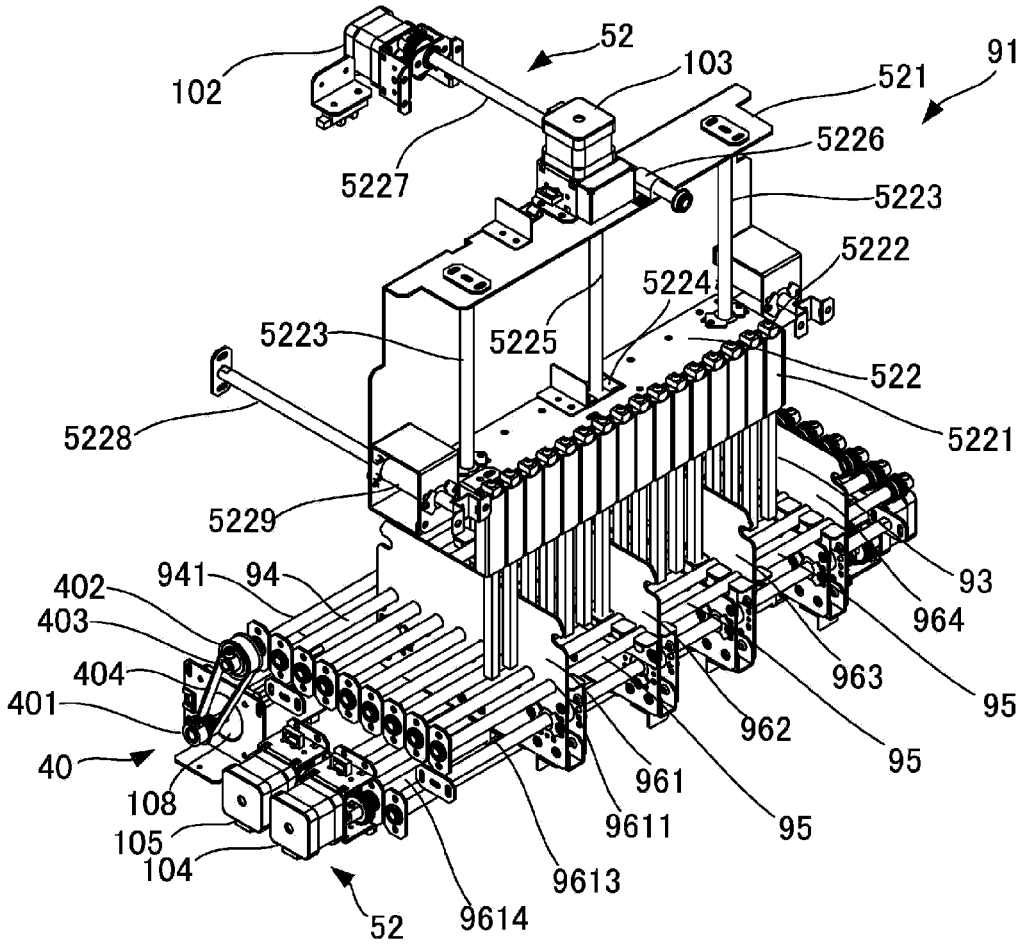
FIG. 4 is a perspective view of a stacking conveyor.

A configuration of the stacking conveyor 91 will then be described. As shown in FIG. 4, the stacking conveyor 91 includes: the placement section 95 that receives the cut sheets Q after machining processing continuously ejected from the device body 1 (machining processing section); and the plurality of rollers 94 (driving rollers) as the conveyance rollers that continuously conveys received cut sheets Q stacked by sorting unit to the stacker section 92.

The means for stacking and conveying the stacked cut sheets Q' can thus be simply configured at a low cost.

Abutment guides 93 and side guides 961 to 964 are driven by a guide drive section 52, while the plurality of rollers 94 are driven by the roller drive section 40. Both the drive sections are electrically connected to the controller 45, which controls the amount of drive so that respective guide positions are adjusted. The guide drive section 52 includes: a motor 103 for vertically driving the abutment guide 93; a motor 102 for driving the abutment guide 93 in the forward and backward directions of the conveyance direction F; and motors 104 to 107 for driving the side guides 961 to 964 in the transverse direction i.e. the conveyance width direction. The roller drive section 40 includes a motor 108 for rotationally driving the plurality of roller 94. In Example, the motor 101 is a DC gear motor, and the other motors 102 to 108 are stepping motors.

The abutment guides 93 restrict leading edges of cut sheets Q after machining processing ejected in the conveyance direction F from the device body 1 (machining processing section) so that the cut sheets Q are stacked on the placement section 95 with their front edges aligned. At that time, the side guides 961 to 964 are used to enable alignment of left and right edges in the width direction W orthogonal to the conveyance direction F. Example exemplifies the case where machined cut sheets Q shown in FIG. 2 are ejected in three rows from the device body 1 and received on the placement section 95.

The abutment guides 93 are a plurality of guide members, which are each fitted to a corresponding one of guide folders 5221 integrally attached to a subframe 522. The guide folders 5221 are cylindrically formed, while the guide members each have a stopper 5222 attached at its top and are each inserted from above into a corresponding one of the guide folders 5221 so as to be vertically and transversely movable to a restricting position of the stopper by its own weight. The transverse movement allows a minute movement by the gap between the guide member and the guide folder 5221.

Description will then be given of a drive mechanism in the guide drive section 52 that causes the abutment guide 93 to move vertically. The subframe 522 is configured to be vertically slidably movable, via guide shafts 5223 disposed at two points in the conveyance width direction, relative to a main frame 521. This subframe 522 has a lead nut 5224 integrally fixed thereto, into which a lead screw 5225 is screwed. The lead screw 5225 is integrally rigidly secured to a rotating shaft of the motor 103 fixed to the main frame 521 so that by rotationally driving the motor 103 the subframe 522 is vertically driven via the lead nut 5224 screwed onto the lead screw 5225. As a result, the abutment guides 93 can be vertically driven.

FIG. 4 shows the state where the abutment guides 93 advance downward relative to the conveyance surface of the conveyance path when stacking cut sheets Q, while FIG. 5 shows the state where the abutment guides 93 retreat upward relative to the conveyance path when conveying stacked cut sheets Q' downstream. The conveyance surface is a plane containing top ends of the plurality of rollers 94 and is a plane via which a cut sheet Q lying at the bottom is supported by the rollers 94.

Description will then be given of a drive mechanism in the guide drive section 52 that causes the abutment guides 93 to slide in the forward and backward directions of the conveyance direction F. The main frame 521 is configured to be slidably movable in the forward and backward directions of the conveyance direction F via guide shafts 5228 disposed at two points in the conveyance width direction on the main frame 521 to be fitted in linear bushings 5229. This main frame 521 has a lead nut 5226 integrally fixed thereto, into which a lead screw 5227 is screwed. The lead screw 5227 is integrally rigidly secured to a rotating shaft of the motor 102 so that by rotationally driving the motor 102 the entire unit including the main frame 521 and the subframe 522 is driven in the forward and backward directions via the lead nut 5226 screwed onto the lead screw 5227. As a result, depending on the size of the cut sheet Q to be stacked, the abutment guides 93 can be slidably moved in the forward and backward directions of the conveyance direction F in the placement section. Although in FIGS. 3 to 6 one ends of the motor 102 and the guide shaft 5228 are expressed in the air space on the drawings, actually they are integrally fixed to an external frame (not shown) arranged around the outside of the main frame 521 and the subframe 522.

Description will then be given of drive mechanisms in the guide drive section 52 that drive the side guides 961 to 964 in the transverse direction i.e. the conveyance width direction. Since the drive mechanisms of the side guides 961 to 964 each have the same configuration, one of them will be taken up and described. The side guide 961 has, in its side wall, notches 9611 each receiving a corresponding one of the plurality of rollers 94 so that its setting position in the paper conveyance width direction can be adjusted via the notches 9611.

According to this, there are no problems such as paper slipping through gaps between the side wall and the plurality of rollers, achieving improvement in alignment performance in the paper conveyance width direction of cut sheets Q stacked on the paper sorting device 2.

Between adjacent ones of the plurality of roller 94 there is disposed an auxiliary guide 9612 (shown in FIG. 6) to fill a corresponding one of gaps on a paper conveyance path. The auxiliary guide 9612 is attached to each of the side guides 961 to 964.

This can prevent occurrence of jam that is paper jamming on the paper conveyance path.

The side guide 961 has a lead nut 9613 integrally fixed thereto, into which a lead screw 9614 is screwed. The lead screw 9614 is integrally rigidly secured to a rotating shaft of the motor 104 so that by rotationally driving the motor 104 the side guide 961 is moved in the transverse direction i.e. the paper conveyance width direction, depending on the size of the cut sheet Q to be stacked, via the lead nut 9613 screwed on the lead screw 9614.

At the time when the side guide 961 moves in the transverse direction i.e. the paper conveyance width direction depending on the size of the cut sheet Q, it moves with the abutment guides 93 retracted upward relative to the conveyance path. In the process of the abutment guides 93 advancing downward after position adjustment of the side guide 961, any of the plurality of guide members may hit the top end of the side guide 961. However, since the guide members are each configured to be movable vertically and transversely by its own weight up to the restriction position of the stopper, the guide member hitting the top end of the side guide 961 can rise upward and retract. Or, by allowing the guide member hitting the top end of the side guide 961 to shift transversely by the gap between the guide member and the guide folder 5221, the guide member can avoid the top end of the side guide 961.

Figure 6:
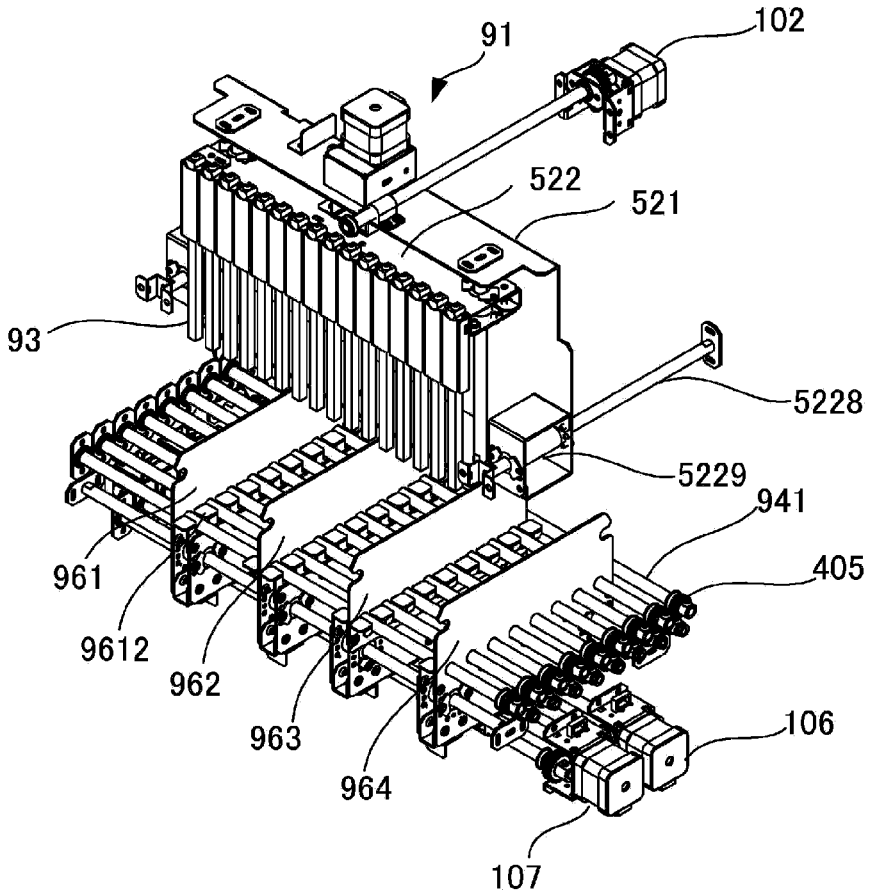
FIG. 6 is a perspective view of the stacking conveyor.

A rotational drive mechanism of the plurality of rollers 94 in the roller drive section 40 will next be described. The roller drive section 40 is a drive mechanism for rotating the plurality of rollers 94 to convey sorting processed stacked cut sheets Q' downstream in the paper conveyance direction F. The roller drive section 40 includes: the drive motor 108 acting as drive means; a pulley 401 attached to a rotating shaft of the drive motor 108; a pulley 402 attached to a rotating shaft 403 of a roller 941; and a timing belt 404 passing over the pulleys 401 and 402. When the drive motor 108 is rotationally driven, its driving force is transmitted via the pulleys 401 and 402 to the rotating shaft 403 of the roller 941, with the result that the roller 941 rotates. As shown in FIG. 6, the roller 941 has a gear 405 attached thereto on the side confronting the drive motor 108, with the other rollers 94 having respective gears 405 on the same side. These gears 405 are intermeshed in turn so that rotational drive from the roller 941 is transmitted in order to all of the other rollers 94.

Sorting Action of Paper Sorting Device 2

Upon using the machining processing device D, the user enters various types of machining processing information by use of the operation panel 46 shown in FIG. 1. When executing the same processing as the processing contents already registered and stored in the storage, the user operates the operation panel 46 as the operation section to enter the number, the title or name of processing, or the like to thereby call required machining processing information from the storage. The user then enters the number of sheets S to be processed and the number (sorting unit) of cut sheets Q after machining processing to be sorted by using the operation panel 46 and thereafter performs an operation to start machining processing.

At this time, depending on the size of cut sheets Q after machining processing among the entered various types of machining processing information, the positions to set the abutment guides 93 and the side guides 961 to 964 are automatically adjusted in advance. The abutment guides 93 restrict the leading edges of cut sheets Q after machining processing ejected in the conveyance direction F from the device body 1 (machining processing section), whereby the cut sheets Q are stacked on the placement section 95 with their front edges aligned. The side guides 961 to 964 can align the left and right edges of the cut sheets Q in the width direction W orthogonal to the conveyance direction F. The abutment guides 93 are set such that at this time the abutment guides 93 advance downward relative to the conveyance path. The abutment guides 93 and the side guides 961 to 964 may be configured so as to be able to perform jogger action that is paper alignment action.

When the operation to start machining processing is performed by the user, sheets S stacked on the feeding section 3 of the machining processing device D are fed to the conveyance path 5 of the device body 1, and the machining processing section 24 applies predetermined machining processing to a predetermined position on the sheets S conveyed. The cut sheets Q after machining processing are ejected from the device body 1 toward the paper sorting device 2.

The paper sorting device 2 includes the stacking conveyor 91 and the stacker section 92. The cut sheets Q after machining processing ejected from the device body 1 are first received on the placement section 95 of the stacking conveyor 91 and stacked by sorting unit, and thereafter continuously conveyed to the stacker section 92 arranged downstream for each unit of stacked cut sheets Q'. In Example, the stacking conveyor 91 includes the conveyance rollers that are the plurality of rotating rollers 94 on which the stacked cut sheets Q' are stacked. The stacking conveyor 91 may be configured to include the belt conveyor 88 having the running-around belt on which the stacked cut sheets Q' are stacked, in lieu of the plurality of rollers 94.

The stacker section 92 continuously stacks the stacked cut sheets Q' conveyed from the stacking conveyor 91 at different positions on the placement surface 83. The controller 45 provides control such that a predetermined gap is formed between precedingly conveyed stacked cut sheets Q' and succeeding stacked cut sheets Q' among units of stacked cut sheets Q' conveyed to the stacker section 92 by the stacking conveyor 91. The stacker section 92 includes the belt conveyor 86 having the running-around belt on which the stacked cut sheets Q' are stacked.

The stacking conveyor 91 can stack plural units of stacked cut sheets Q' in the conveyance direction. In the stacking conveyor 91, the controller 45 provides control at least such that upon stacking cut sheets Q, the cut sheets Q are received and stacked by sorting unit with convey stopped, after which the stacked cut sheets Q' are accumulated while being sequentially stepwise shifted and the stacked cut sheets Q' are sequentially stepwise delivered to the stacker section 92 from the accumulated stacked cut sheets Q'.

According to the above, the sorting work efficiency can be improved.

Sorting action of the paper sorting device 2 will then be described based on specific Example. FIGS. 7A to 9K are diagrammatic views showing how the paper sorting device performs sorting action. In FIGS. 7A to 9K, the side guides 961 to 964 are not shown.

The sorting action of the paper sorting device 2 in Example is described about a series of sorting actions performed when a sheet S with the machining processing pattern of FIG. 2 is ejected as cut sheets Q after machining processing from the device body 1.

Figure 7A:
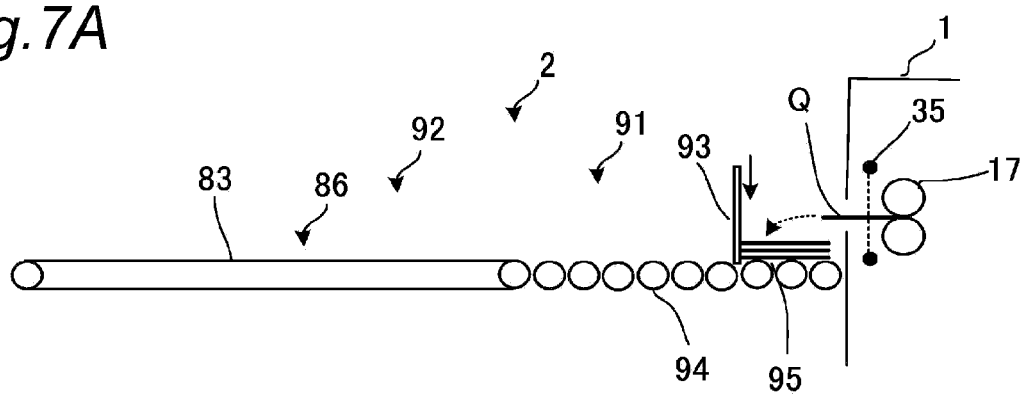
FIGS. 7A, 7B, 7C and 7D are diagrammatic views showing how the paper sorting device performs sorting action.

(1) As shown in FIG. 7A, cut sheets Q after machining processing are continuously ejected from the conveyance rollers 17 of the device body 1 toward the placement section 95 of the stacking conveyor 9, and stacked thereon with the cut sheets Q aligned by the abutment guides 93 and the side guides 961 to 964. The number of the cut sheets Q ejected from the device body 1 is counted by the fifth detecting section 35.

Figure 7B:
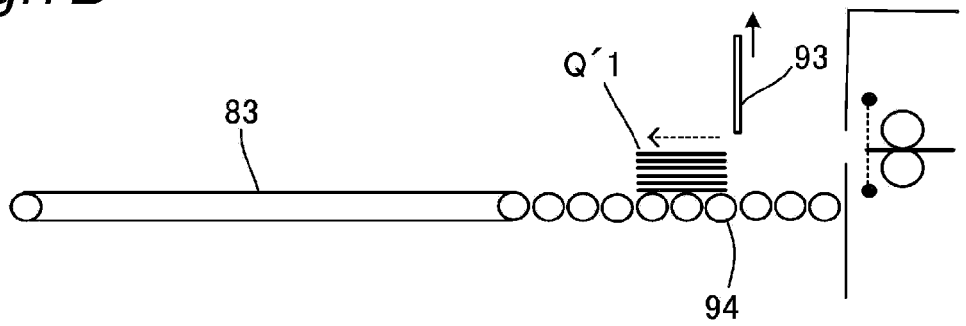

(2) Next, after the number of the cut sheets Q stacked on the placement section 95 reaches the number to be sorted (sorting unit), the abutment guides 93 are retracted upward as shown in FIG. 7B. Subsequently, the roller drive section 40 rotationally drives the plurality of rollers 94 to convey stacked cut sheets Q'1 downstream by a predetermined distance (approximately, by the amount equal to the sum of the length of the cut sheet Q in the conveyance direction and the thickness of the abutment guide 93), to stop the rotational drive. At this time, ejection of the cut sheets Q from the conveyance rollers 17 of the device body 1 is stopped.

Figure 7C:
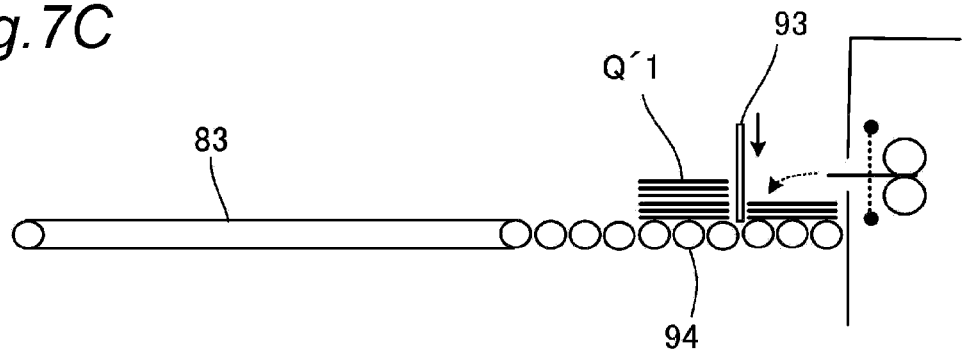

(3) Next, as shown in FIG. 7C, after the abutment guides 93 again advance downward relative to the conveyance path, ejection of the cut sheets Q from the conveyance rollers 17 of the device body 1 is resumed.

Figure 7D:
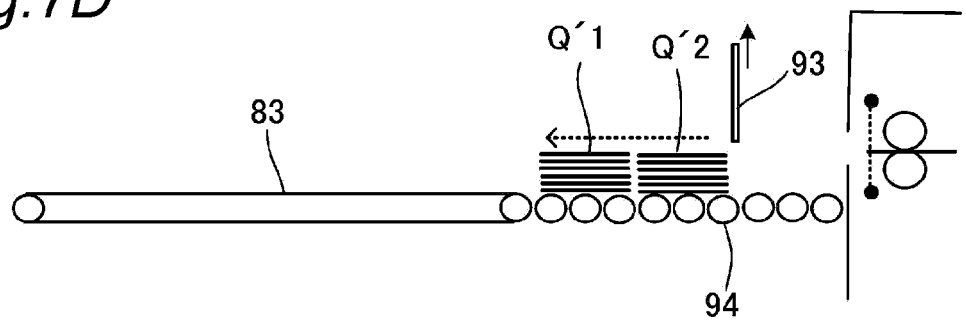

(4) Next, after the number of the cut sheets Q stacked on the placement section 95 reaches the number to be sorted (sorting unit), the abutment guides 93 are retracted upward as shown in FIG. 7D. Then the roller drive section 40 rotationally drives the plurality of rollers 94 to convey stacked cut sheets Q'1 and Q'2 downstream by the predetermined distance, to stop the rotational drive. At this time, ejection of the cut sheets Q from the conveyance rollers 17 of the device body 1 is stopped.

Figure 8E:
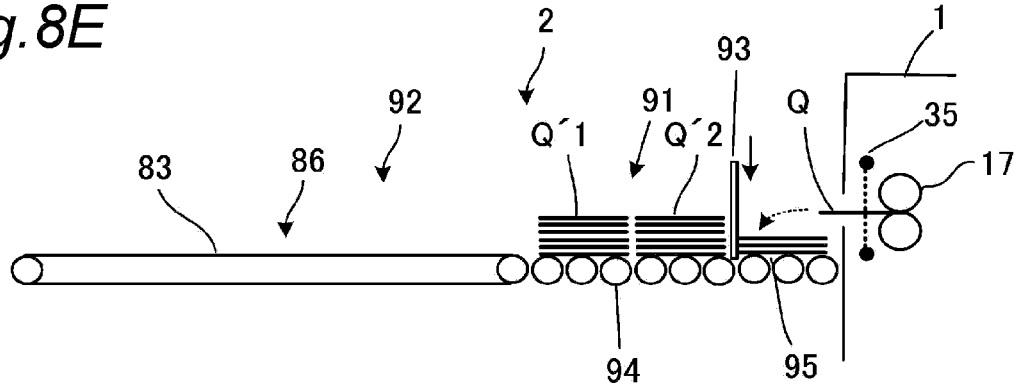
FIGS. 8E, 8F, 8G and 8H are diagrammatic views showing how the paper sorting device performs sorting action.

(5) Next, as shown in FIG. 8E, after the abutment guides 93 again advance downward relative to the conveyance path, ejection of the cut sheets Q from the conveyance rollers 17 of the device body 1 is resumed.

Figure 8F:
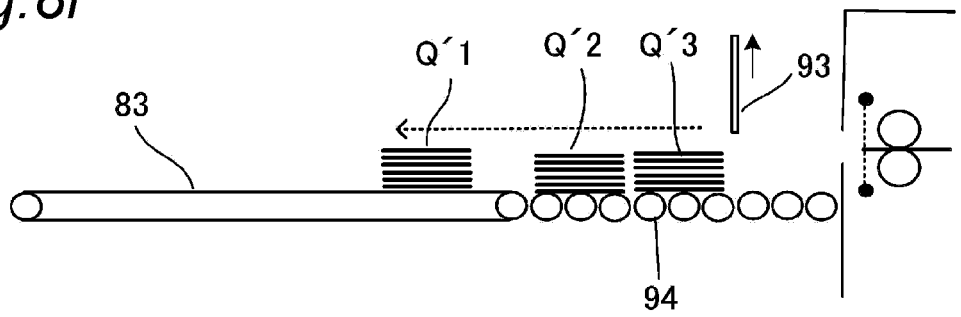

(6) Next, after the number of the cut sheets Q stacked on the placement section 95 reaches the number to be sorted (sorting unit), the abutment guides 93 are retracted upward as shown in FIG. 8F. Then the roller drive section 40 rotationally drives the plurality of rollers 94 to convey stacked cut sheets Q'1, Q'2, and Q'3 downstream by the predetermined distance, to stop the rotational drive. At that time, only the stacked cut sheet Q'1 is delivered from the stacking conveyor 91 to the placement section 83 (belt conveyor 86) of the stacker section 92. During conveying the stacked cut sheets Q'1, Q'2, and Q'3, the belt conveyor 86 is rotationally driven by the conveyor drive section 51 to receive the stacked cut sheets Q'1 from the stacking conveyor 91 onto the stacker section 92, and then comes to a stop. At this time, ejection of the cut sheets Q from the conveyance rollers 17 of the device body 1 is stopped.

Figure 8G:
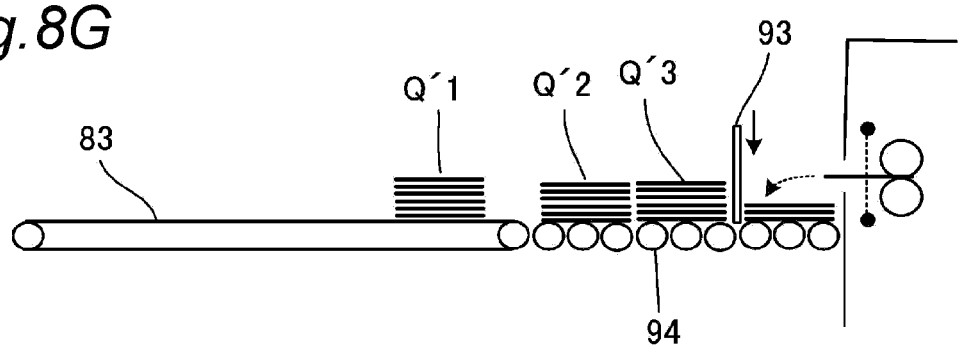

(7) Next, as shown in FIG. 8G, after the abutment guide 93 again advances downward relative to the conveyance path, ejection of the cut sheets Q from the conveyance rollers 17 of the device body 1 is resumed.

Figure 8H:
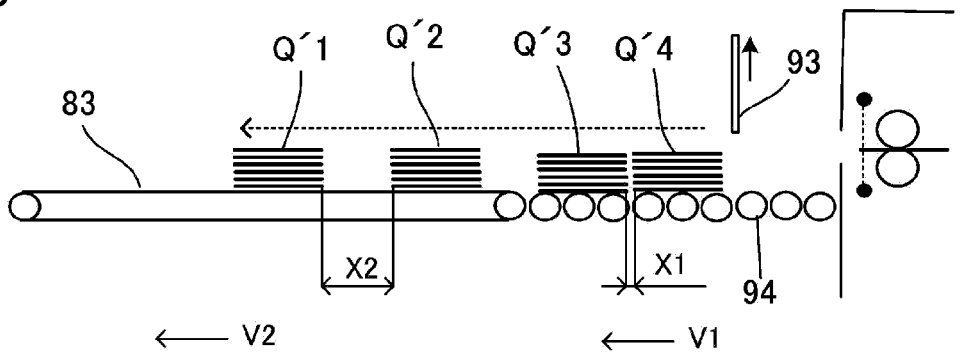

(8) Next, after the number of the cut sheets Q stacked on the placement section 95 reaches the number to be sorted (sorting unit), the abutment guides 93 are retracted upward as shown in FIG. 8H. Then the roller drive section 40 rotationally drives the plurality of rollers 94 to convey the stacked cut sheets Q'2, Q'3, and Q'4 downstream by the predetermined distance, to stop the rotational drive. At that time, only the stacked cut sheet Q'2 is delivered from the stacking conveyor 91 to the placement section 83 (belt conveyor 86) of the stacker section 92. During conveying the stacked cut sheets Q'2, Q'3, and Q'4, the belt conveyor 86 is rotationally driven by the conveyor drive section 51 to receive the stacked cut sheets Q'2 from the stacking conveyor 91 onto the stacker section 92, and then comes to a stop. At this time, ejection of the cut sheets Q from the conveyance rollers 17 of the device body 1 is stopped.

The stacking conveyor 91 and the stacker section 92 are configured to be driven independently of each other. Individual control is provided via the controller 45 by the roller drive section 40 and the conveyor drive section 51, respectively, to a gap X1 between adjacent stacked cut sheets Q' on the stacking conveyor 91 and a gap X2 between adjacent stacked cut sheets Q' on the stacker section 92. X1 is approximately a gap equal to the sum of the thickness of the abutment guide 93 and a margin allowing the abutment guide 93 to smoothly advance and retreat, and may be a gap of the order of 10 mm. X2 is a gap required for the user to easily remove stacked cut sheets Q' on the belt conveyor, and is generally a gap of the order of about 20 mm to 50 mm. Both have a relationship of X1<X2. Conveyance velocities V1 and V2 of the stacked cut sheets Q' on the stacking conveyor 91 and the stacker section 92, respectively, have also a relationship of V1<V2. That is, upon delivering (shifting) the stacked cut sheets Q' from the stacking conveyor 91 to the stacker section 92, control is provided to accelerate the conveyance velocity to widen the gap from X1 to X2. Although in Example the number of the stacked cut sheets Q' arrayed on the stacking conveyor 91 is three, this is not limitative and the number may be two or may be more than four. Although the number of the stacked cut sheets Q' arrayed on the stacker section 92 is two in description, this is not limitative and the number may be more than three.

According to the above, if only the minimum gap X1 between adjacent stacked cut sheets Q' is secured on the stacking conveyor 91 and then if the stacked cut sheets Q' are merely delivered to the stacker section 92 while being shifted, the control to widen the gap X1 up to the gap X2 allowing easy removal of the stacked cut sheets Q' is automatically provided independently of the stacking conveyor 91, whereupon downtime of the stacking conveyor 91 can be minimized, leading to improved work efficiency. In the prior art, ejected cut sheets Q are conveyed downstream with a predetermined gap while being stacked every specified number on a single (one-drive) belt conveyor, whereupon stacking work (ejection work) of succeeding ejected sheets needs to be stopped during transfer of the preceding sheets (during running of the belt conveyor) until a predetermined gap is secured on the downstream side, resulting in poor work efficiency.

Figure 9I:
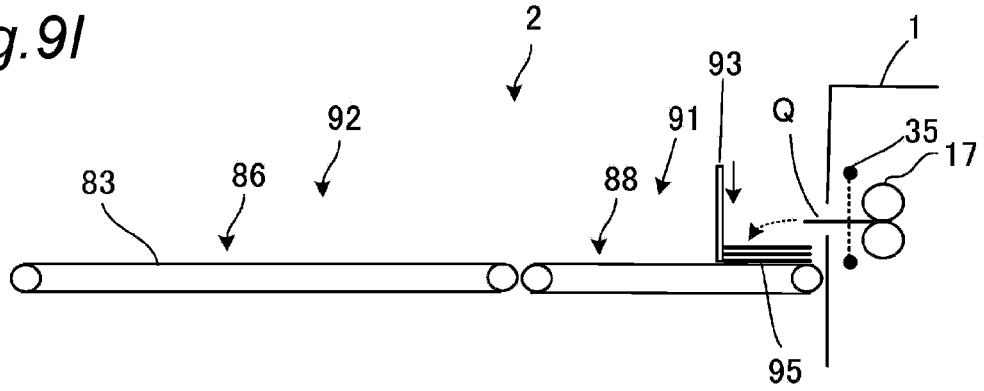
Figure 9J:
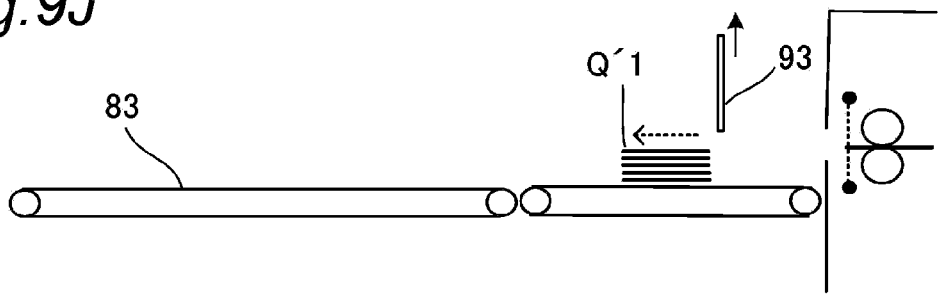
Figure 9K:
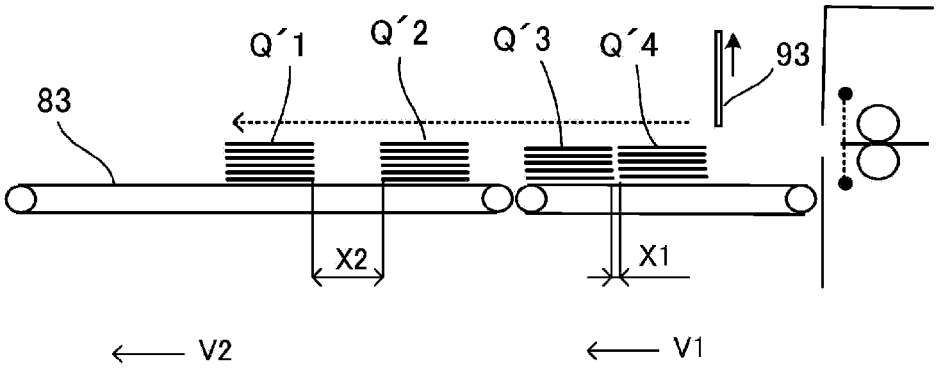

(9) The stacking conveyor 91 shown in FIGS. 91 to 9K includes the belt conveyor 88 having the running-around belt on which the stacked cut sheets Q' are stacked, in place of the plurality of rollers 94 shown in FIGS. 7A to 8H. The control action itself is the same as in the case of using the plurality of rollers 94. FIGS. 91 and 9J correspond to FIGS. 7A and 7B, respectively, and FIG. 9K corresponds to FIG. 8H (FIGS. 7C to 8G have no corresponding FIG. 9 drawings).

Although in the above embodiment the case has been described as an example where the conveyance velocity V1 of the stacking conveyor 91<the conveyance velocity V2 of the stacker section 92 is set to achieve a relationship of X1<X2 between the gap X1 on the stacking conveyor 91 and the gap X2 on the stacker section 92, the present disclosure is not limited to such a case. For example, to achieve the relationship of X1<X2, the transfer time (drive time at V2) in the stacker section 92 may be set longer than the transfer time (drive time at V1) in the stacking conveyor 91 with the conveyance velocity V1 of the stacking conveyor 91 being equal to the conveyance velocity V2 of the stacker section 92. In the case of achieving the relationship of X1<X2 based on the difference in transfer time, there is no particular limitation on the magnitude relationship between V1 and V2. When V1=V2, smooth delivery of the stacked cut sheets from the stacking conveyor 91 to the stacker section 92 is ensured.

By being combined with the machining processing device D, the paper sorting device 2 according to the present disclosure enables improvement in sorting work efficiency and alignment performance in the paper conveyance direction of cut sheets stacked on the paper sorting device 2. The paper sorting device 2 may be combined with other paper processing devices that perform sorting processing of other items such as prints, cards, postal items, signatures, etc., or may be disposed at a certain place on a general paper conveyance device.

It will be apparent that the present disclosure is not limited to the embodiment and that the embodiment can be appropriately changed, other than the suggestions in the embodiment, within the scope of the technical ideas of the present disclosure. The number, positions, shapes, etc. of the constituent members are not limited to those in the embodiment, and can be any number, positions, shapes, etc. suited for carrying out the present disclosure.

What is claimed is:

1. A paper sorting device comprising:

a stacking conveyor including a first placement section receiving continuously fed cut sheets to stack the cut sheets by a sorting unit, wherein stacked cut sheets are placed on the first placement section, and a first drive section continuously conveying the stacked cut sheets placed on the first placement section downstream on a unit-by-unit basis along the first placement section;

a stacker section including a second placement section arranged downstream of the stacking conveyor, on which the stacked cut sheets conveyed from the stacking conveyor are placed, and a second drive section continuously conveying the stacked cut sheets placed on the second placement section downstream along the second placement section; and a controller configured to control the first drive section and the second drive section such that precedingly conveyed stacked cut sheets and succeeding stacked cut sheets among plural units of the stacked cut sheets conveyed to the stacker section by the stacking conveyor are placed, with a predetermined gap formed therebetween, at different positions on the second placement section, wherein in the stacking conveyor, the first placement section includes conveyance rollers that are a plurality of rotating rollers on which the stacked cut sheets are stacked, and the first drive section is a motor driving the conveyance rollers, and wherein the stacking conveyor comprises side guides that, during stacking continuously ejected cut sheets, restrict the cut sheets in a paper conveyance width direction, the side guides each having a side wall with notches each receiving a corresponding one of the plurality of rollers so that their respective setting positions in the paper conveyance width direction are adjustable through the notches.

2. The paper sorting device according to claim 1, wherein the first placement section of the stacking conveyor allows plural units of the stacked cut sheets to be placed thereon in a conveyance direction, and the controller provides control in the first placement section of the stacking conveyor at least such that upon stacking the cut sheets, the cut sheets are received and stacked by the sorting unit with transfer stopped, after which the stacked cut sheets are accumulated as plural units of the stacked cut sheets while being sequentially stepwise shifted, the stacked cut sheets being sequentially stepwise delivered to the second placement section of the stacker section from the accumulated units of the stacked cut sheets.

3. The paper sorting device according to claim 1, wherein the first drive section of the stacking conveyor and the second drive section of the stacker section are driven independently of each other to convey the stacked cut sheets.

4. The paper sorting device according to claim 1, wherein the controller controls the first drive section and the second drive section such that the predetermined gap between adjacent units of the stacked cut sheets placed on the second placement section of the stacker section is greater than a gap between adjacent units of the stacked cut sheets placed on the first placement section of the stacking conveyor.

5. The paper sorting device according to claim 1, wherein in the stacker section, the second placement section is a belt conveyor having a running-around belt wherein the stacked cut sheets are stacked, and the second drive section is a motor driving the running- around belt.

6. A paper sorting device comprising:

a stacking conveyor including a first placement section receiving continuously fed cut sheets to stack the cut sheets by a sorting unit, wherein stacked cut sheets are placed on the first placement section, and a first drive section continuously conveying the stacked cut sheets placed on the first placement section downstream on a unit-by-unit basis along the first placement section;

a stacker section including a second placement section arranged downstream of the stacking conveyor, on which the stacked cut sheets conveyed from the stacking conveyor are placed, and a second drive section continuously conveying the stacked cut sheets placed on the second placement section downstream along the second placement section; and a controller configured to control the first drive section and the second drive section such that precedingly conveyed stacked cut sheets and succeeding stacked cut sheets among plural units of the stacked cut sheets conveyed to the stacker section by the stacking conveyor are placed, with a predetermined gap formed therebetween, at different positions on the second placement section, wherein in the stacking conveyor, the first placement section includes conveyance rollers that are a plurality of rotating rollers on which the stacked cut sheets are stacked, and the first drive section is a motor driving the conveyance rollers, and wherein the stacking conveyor comprises, between adjacent ones of the plurality of roller, an auxiliary guide for filling a corresponding one of gaps on a paper conveyance path.

7. A machining processing device comprising:

a machining processing section including a machining member that performs predetermined machining processing at a predetermined position on a sheet conveyed; and a paper sorting device according to claim 1 that receives cut sheets after machining processing continuously ejected from the machining processing section.

8. A paper sorting device comprising:

a stacking conveyor including a first placement section receiving continuously fed cut sheets to stack the cut sheets by a sorting unit, wherein stacked cut sheets are placed on the first placement section, and a first drive section continuously conveying the stacked cut sheets placed on the first placement section downstream on a unit-by-unit basis along the first placement section;

a stacker section including a second placement section arranged downstream of the stacking conveyor, on which the stacked cut sheets conveyed from the stacking conveyor are placed, and a second drive section continuously conveying the stacked cut sheets placed on the second placement section downstream along the second placement section; and a controller configured to control the first drive section and the second drive section such that precedingly conveyed stacked cut sheets and succeeding stacked cut sheets among plural units of the stacked cut sheets conveyed to the stacker section by the stacking conveyor are placed, with a predetermined gap formed therebetween, at different positions on the second placement section, wherein in the stacking conveyor, the first placement section includes conveyance rollers that are a plurality of rotating rollers on which the stacked cut sheets are stacked, and the first drive section is a motor driving the conveyance rollers, and wherein in order to receive and stack cut sheets continuously ejected by the sorting unit, the stacking conveyor comprises an abutment guide that advances relative to a conveyance path at least upon stacking, to restrict leading edges of the cut sheets, and wherein the leading edges of the cut sheets restricted by the abutment guide are downstream-side edges of the cut sheets in a conveying direction of the cut sheets conveyed by the first drive section on the first placement section.

9. The paper sorting device according to claim 6, wherein the first placement section of the stacking conveyor allows plural units of the stacked cut sheets to be placed thereon in a conveyance direction, and the controller provides control in the first placement section of the stacking conveyor at least such that upon stacking the cut sheets, the cut sheets are received and stacked by the sorting unit with transfer stopped, after which the stacked cut sheets are accumulated as plural units of the stacked cut sheets while being sequentially stepwise shifted, the stacked cut sheets being sequentially stepwise delivered to the second placement section of the stacker section from the accumulated units of the stacked cut sheets.

10. The paper sorting device according to claim 6, wherein the first drive section of the stacking conveyor and the second drive section of the stacker section are driven independently of each other to convey the stacked cut sheets.

11. The paper sorting device according to claim 6, wherein the controller controls the first drive section and the second drive section such that the predetermined gap between adjacent units of the stacked cut sheets placed on the second placement section of the stacker section is greater than a gap between adjacent units of the stacked cut sheets placed on the first placement section of the stacking conveyor.

12. The paper sorting device according to claim 6, wherein in the stacker section, the second placement section is a belt conveyor having a running-around belt wherein the stacked cut sheets are stacked, and the second drive section is a motor driving the running-around belt.

13. A machining processing device comprising:

a machining processing section including a machining member that performs predetermined machining processing at a predetermined position on a sheet conveyed; and a paper sorting device according to claim 6 that receives cut sheets after machining processing continuously ejected from the machining processing section.

14. The paper sorting device according to claim 8, wherein the first placement section of the stacking conveyor allows plural units of the stacked cut sheets to be placed thereon in a conveyance direction, and the controller provides control in the first placement section of the stacking conveyor at least such that upon stacking the cut sheets, the cut sheets are received and stacked by the sorting unit with transfer stopped, after which the stacked cut sheets are accumulated as plural units of the stacked cut sheets while being sequentially stepwise shifted, the stacked cut sheets being sequentially stepwise delivered to the second placement section of the stacker section from the accumulated units of the stacked cut sheets.

15. The paper sorting device according to claim 8, wherein the first drive section of the stacking conveyor and the second drive section of the stacker section are driven independently of each other to convey the stacked cut sheets.

16. The paper sorting device according to claim 8, wherein the controller controls the first drive section and the second drive section such that the predetermined gap between adjacent units of the stacked cut sheets placed on the second placement section of the stacker section is greater than a gap between adjacent units of the stacked cut sheets placed on the first placement section of the stacking conveyor.

17. The paper sorting device according to claim 8, wherein in the stacker section, the second placement section is a belt conveyor having a running-around belt wherein the stacked cut sheets are stacked, and the second drive section is a motor driving the running-around belt.

18. A machining processing device comprising:

a machining processing section including a machining member that performs predetermined machining processing at a predetermined position on a sheet conveyed; and a paper sorting device according to claim 8 that receives cut sheets after machining processing continuously ejected from the machining processing section.

* * * * *